US005673512A

United States Patent [19]

Dupre

[11] Patent Number: 5,673,512

[45] Date of Patent: Oct. 7, 1997

[54] PORTABLE MASONRY PIER

[76] Inventor: Herman K. Dupre, c/o Seven Springs, Champion, Pa. 15622

[21] Appl. No.: 583,182

[22] Filed: Jan. 4, 1996

[51] Int. Cl.[6] ..... A01G 31/02

[52] U.S. Cl. ..... 47/81; D11/143; D11/155; D34/1; 206/417; 206/524.1; 220/453; 220/466; 220/468; 220/908; 249/83; 264/262; 405/52; 405/303

[58] Field of Search ..... 47/82, 65.7, 83, 47/81; 405/52, 303; 220/9.1, 460, 461, 453, 466, 468, 484, 908, 400–403; 206/417, 524.1, 524.2, 524.3; 249/83; 264/262; 52/19–21; 404/2, 4, 26, 25; D11/143, 155; D34/1

[56] References Cited

U.S. PATENT DOCUMENTS 858,939 7/1907 Angeloro ..... 47/65.7 X 1,689,418 10/1928 Young ..... 47/65.7 X 4,875,622 10/1989 Lents ..... 232/39

5,361,977 11/1994 Ogrodnick, Jr. ..... 232/39

*Primary Examiner*—Dennis L. Taylor

*Attorney, Agent, or Firm*—Carothers & Carothers

[57] ABSTRACT

A portable masonry pier constructed of a used steel drum, a reinforcing rod frame which surrounds the drum in a masonry wall which is laid up around the frame and secured with mortar to the frame. The mortar is also internally confined by the drum. Removable fasteners secure the frame to the drum and are provided with lifting rings to lift and move the composite pier structure as a unit.

11 Claims, 3 Drawing Sheets

PORTABLE MASONRY PIER

BACKGROUND OF THE INVENTION

This invention relates to free standing portable structures such as working area traffic control piers, planters and trash cans or receptacles which can be used either inside or outside.

Free standing structures of the type to which the present invention relates, include, in addition to those already referenced, fence posts, surrounding guards for light posts and the like and decorative parking barriers.

Such roadside and inside structures of brick, stone, concrete block or the like have an aesthetic appeal in that they provide a pleasing structure that comports with the color, texture and appearance of other surrounding main structures with which they are associated. In usual construction, they are built up or laid up of solid bricks or stones and they are permanently fixed and not moveable from one location to another. In addition, they are relatively expensive to construct.

The present invention eliminates the high cost and skill associated with laid brick or stone construction of such piers and provides such a masonry structure which is readily moveable or portable.

SUMMARY OF THE INVENTION

The portable masonry pier of the present invention is comprised of a drum having a side wall and a bottom wall and a reinforcing rod frame surrounds the drum. Fasteners may temporarily secure the frame to the drum and a masonry wall is laid up around this reinforcing frame and secured to it with mortar, thereby providing a unitary masonry and drum structure.

Lifting rings are secured to the drum, usually as an integral part of the fasteners, to permit unitary movement of the composite structure with the lifting rings as by a conventional small crane. The fasteners with their associated rings are preferably removable to provide clean protrusion free contours within the interior or on the exterior of the composite masonry pier structure.

The composite masonry pier structure of the present invention can be made very inexpensively by using used and discarded cylindrical steel drums, such as discarded 55 gallon steel drums, and by also using scrap pieces of reinforcing rod or rebar, of 4 feet lengths or less for example, for constructing the reinforcing rod frame. Additionally the mortar may include the use of limestone dust, instead of, or impartial substitution of sand, limestone dust being less expensive than sand.

A trash can liner or planter may be received within the structure in order to convert it to either a trash can and/or a planter. When the composite structure is utilized as a pier or as a trash can, the bottom of the drum is provided with drain perforations so that water does not accumulate within the drum. When the drum is utilized as a planter, the drum may be provided with a non-perforated bottom so that the drum will hold water. A planter may then be provided in the upper end of the drum with a water wick which depends downwardly through the planter to the bottom of the drum for wicking water from the bottom of the drum to soil in the planter.

In order to firmly embed the pier and to further provide a solid foundation on inclined surfaces, the pier may be supported on such irregular surfaces by a sand foundation bed. This not only permits the composite pier structure to be supported in level fashion, but also permits good draining from the structure when desired.

BRIEF DESCRIPTION OF THE DRAWINGS

Other objects and advantages appear in the following description and claims.

The accompanying drawings show, for the purpose of exemplification, without limiting the invention or the claims thereto, certain practical embodiments illustrating the principals of this invention wherein:

DESCRIPTION OF PREFERRED EMBODIMENTS

Figure 1:
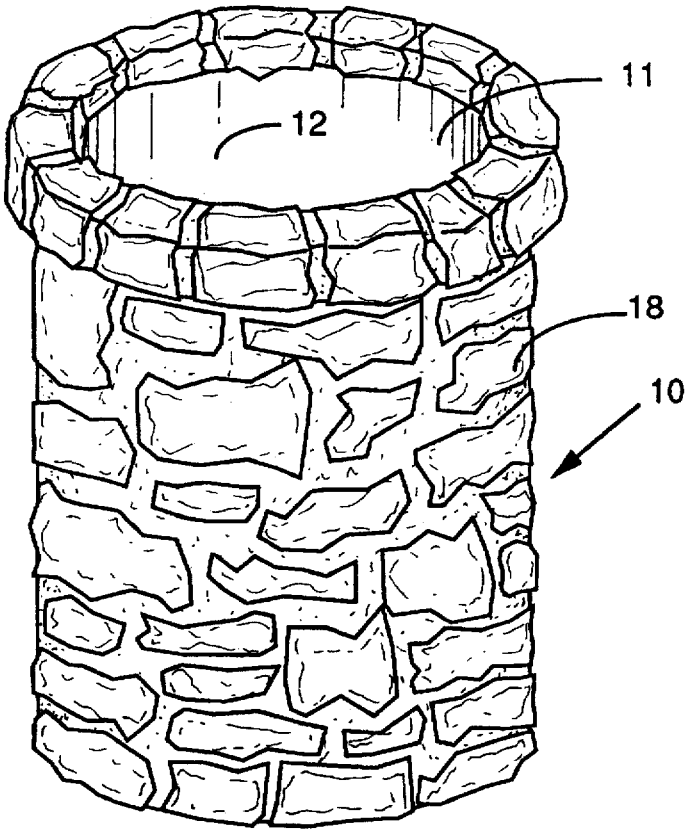
FIG. 1 is a perspective view in vertical side elevation illustrating the composite portable masonry pier structure of the present invention.

Referring to FIGS. 1 through 5, the composite portable masonry pier 10 of the present invention is comprised of an internal drum 11 which is a conventional discarded or used 55 gallon steel drum with the top or bottom removed. The drum accordingly has a cylindrical side wall 12 and a bottom 13. Bottom 13 in this instance is provided with perforations 14 for draining water from the pier structure. In fact, the conventional top screw plug (not shown) in such drums may be used as a removable bottom drain plug.

A reinforcing rod frame 15 surrounds the drum 11. Reinforcing rod frame 15 is constructed of scrap pieces of reinforcement bar or rebar which are normally discarded and generally have a length of 4 feet or less.

Figure 4:
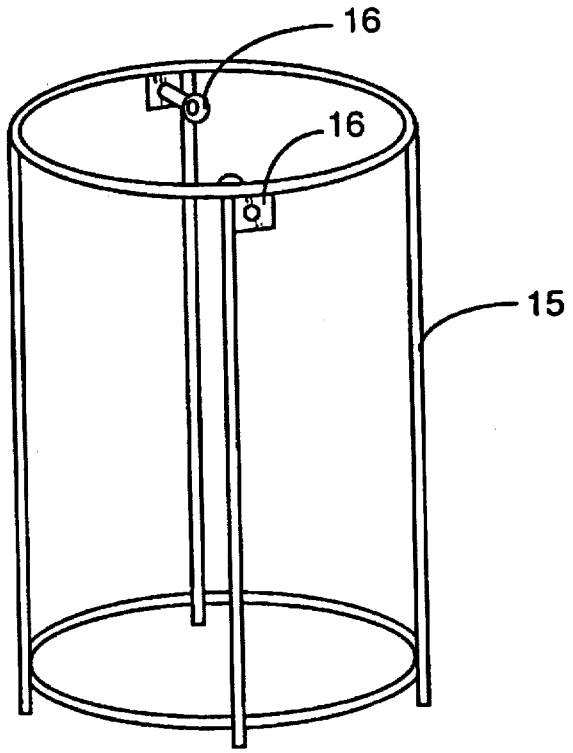
FIG. 4 is a perspective view in side elevation illustrating the reinforcing bar frame utilized in the composite masonry portable pier structure of FIGS. 1 and 2.

While the reinforcing rod frame 15 in FIG. 4 is illustrated as being made of continuous pieces, in fact, the frame may be welded together in segmented scrap pieces.

Figure 2:
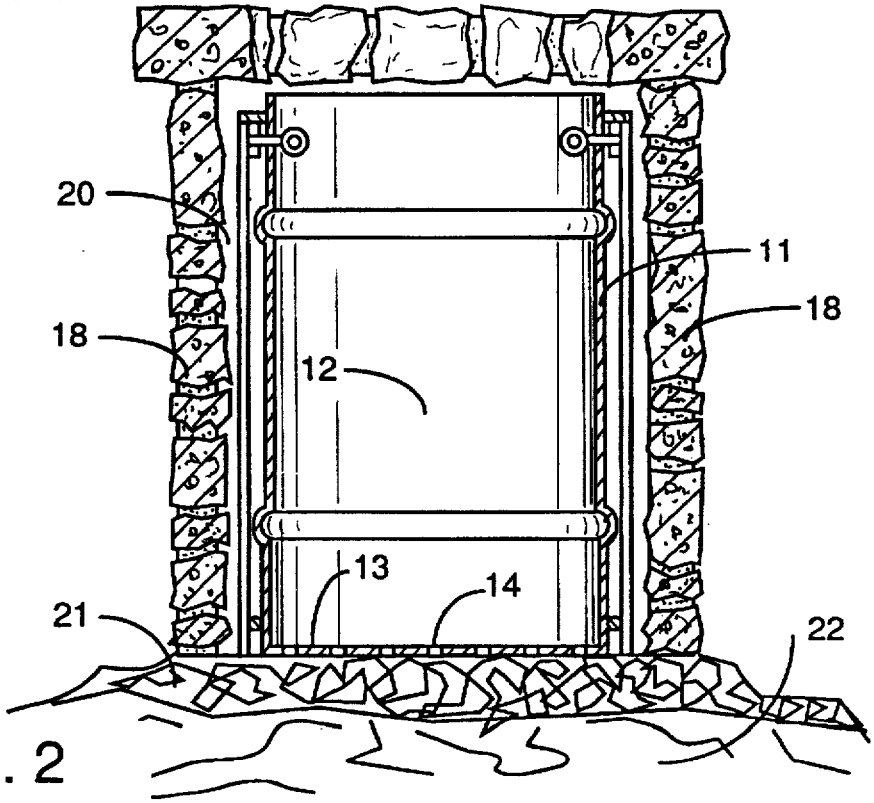
FIG. 2 is a view in vertical mid cross section of the pier structure illustrated in FIG. 1.
Figure 3:
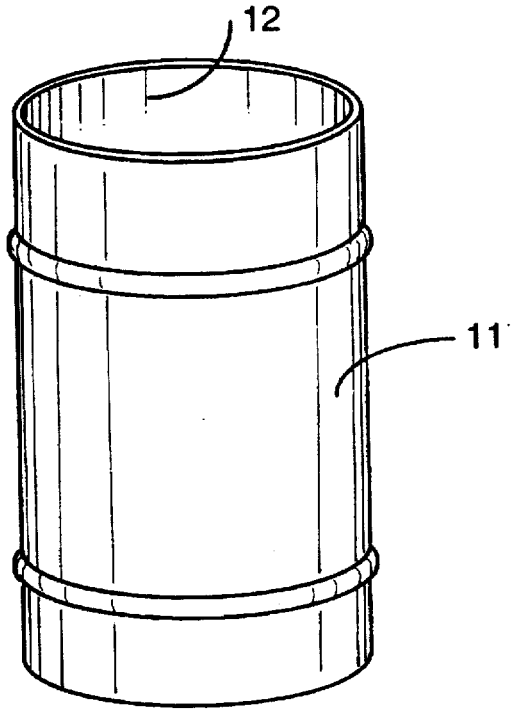
FIG. 3 is a perspective view in side elevation illustrating the drum utilized in the composite portable pier structure shown in FIGS. 1 and 2.
Figure 5:
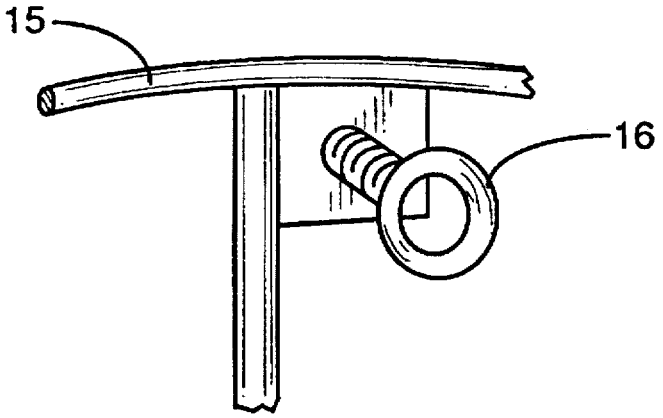
FIG. 5 is an enlarged view of the lifting ring fasteners utilized on the reinforcing rod frame structure of FIG. 4.

Fasteners 16 in the form of threaded bolts with eye rings welded thereto are threadably received in nuts welded to reenforcing rod frame 15 as best illustrated in FIG. 5. These fasteners 16 are removable, and may, as seen in FIG. 2, secure the reinforcing rod frame 15 to drum 11. The fasteners 16 need not necessarily protrude to the inside of drum 11. As an alternative they may protrude through the masonry wall or veneer 18 and thereby protrude to the outside of the composite pier structure, while also being secured to the reinforcing rod frame and to the internal drum 11.

The masonry wall in this instance is illustrated as being stone which is laid up as indicated at 18 around the frame and secured to the frame and confined by the outside diameter of drum 11 with conventional mortar 20. Once the mortar cures, the entire composite structure, including the stone veneer 18, reinforcing frame 15 and internal drum 11 may be lifted as a unitary structure with the aid of a small crane and lifting rings 16.

In order to further economize, sand which is normally used in the mortar mix 20 may be substituted, or partially substituted, with limestone dust, which is less expensive.

With particular reference to FIG. 2, the entire composite pier structure 10 is placed on a sand foundation bed 21 to thereby level the pier structure on the inclined or irregular ground surface 22.

Figure 6:
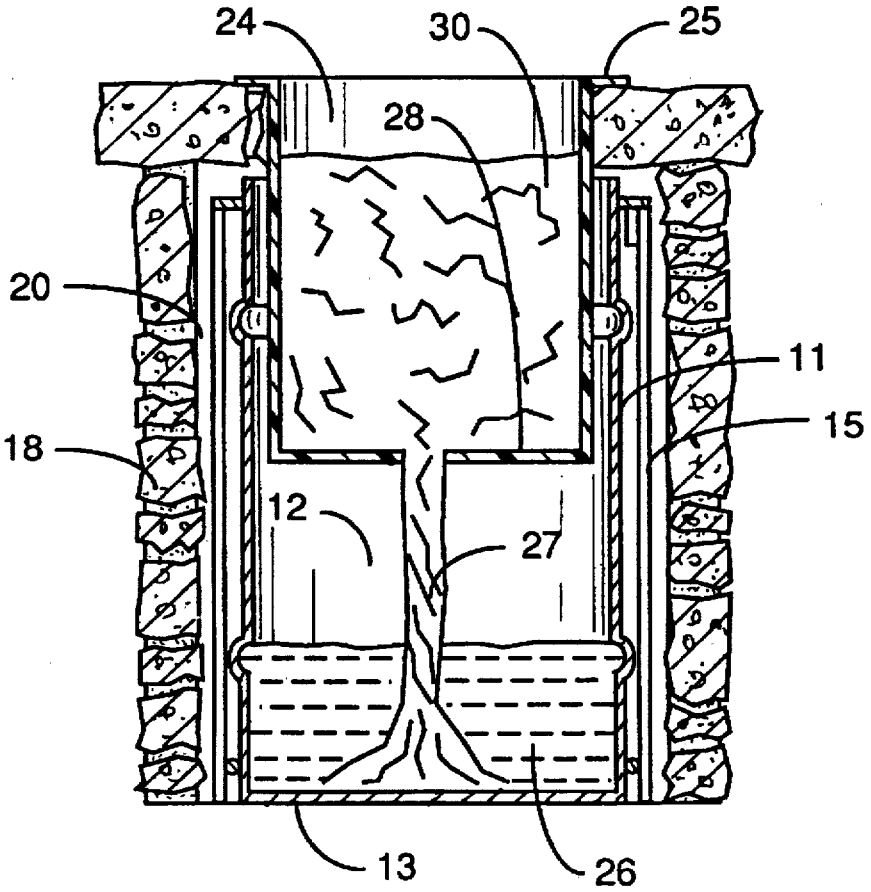
FIG. 6 is a view in side elevation and in vertical cross section of the composite portable masonry pier structure of FIG. 1 illustrating the pier as being adapted for use as either a trash can or a planter.

The composite pier structure may also be readily used or employed as a trash container or as a planter as illustrated in FIG. 6. When it is desired to accordingly use the structure as a trash container or planter, the removable fasteners 16 are removed to provide a clean interior for drum 11.

A plastic liner 24 is then inserted into the upper end of the composite structure 10 and has an upper outwardly protruding annular lip 25 which rests upon the upper perimeter end of the composite pier structure 10. This plastic receptacle 24 may either be used as a trash can liner, which may be removed and dumped, or it may be also utilized as a planter.

In FIG. 6, the receptacle 24 in particular has been adapted for use as a planter and the bottom 13 of drum 11 is here illustrated as continuous or unperforated in order to hold or retain water 26, and a water wick 27 depends downwardly through planter bottom 28 to the bottom of drum 11 for wicking water 26 from the bottom of the drum to soil 30 in planter 24.

I claim:

1. A portable masonry pier comprising: a used cylindrical steel drum having a side wall and a bottom and a top thereof removed, a reinforcing rod frame surrounding said drum, and a masonry wall laid up around said frame and secured thereto with mortar for unitary movement with said drum.

2. The portable masonry pier of claim 1 including at least a pair of lifting rings secured to said frame for lifting said pier, including said drum.

3. The portable masonry pier of claim 2 wherein said lifting rings are integral with fasteners securing said frame and drum together.

4. The portable masonry pier of claim 3 wherein said fasteners are removable.

5. The portable masonry pier of claim 1 wherein said masonry wall is stone.

6. The portable masonry pier of claim 5 wherein said mortar includes limestone dust.

7. The portable masonry pier of claim 1, said drum having at least one drain hole in said bottom.

8. The portable masonry pier of claim 1, including a trash can liner received in said drum.

9. The portable masonry pier of claim 1, said drum being water tight and having an upper end receiving a planter therein, and a water wick depending downwardly through said planter to the bottom of said drum for wicking water from the bottom of said drum to soil in said planter.

10. The portable masonry pier of claim 1 wherein said reinforcing rod frame is composed of welded scrap reinforcing rod pieces.

11. The portable masonry pier of claim 1, including a sand foundation bed under said pier for supporting said pier on irregular surfaces.

* * * * *